US006667677B2

(12) United States Patent
Yajima et al.

(10) Patent No.: US 6,667,677 B2
(45) Date of Patent: Dec. 23, 2003

(54) MAGNET MOVABLE ELECTROMAGNETIC ACTUATOR

(75) Inventors: Hisashi Yajima, Tsukuba-gun (JP); Kazuya Tamura, Tsukuba-gun (JP)

(73) Assignee: SMC Corporation, Tokyo (JP)

( * ) Notice: Subject to any disclaimer, the term of this patent is extended or adjusted under 35 U.S.C. 154(b) by 15 days.

(21) Appl. No.: 09/900,052

(22) Filed: Jul. 9, 2001

(65) Prior Publication Data

US 2002/0008601 A1 Jan. 24, 2002

(30) Foreign Application Priority Data

Jul. 18, 2000 (JP) ..... 2000-217304
May 30, 2001 (JP) ..... 2001-162717

(51) Int. Cl.[7] ..... H01F 7/08

(52) U.S. Cl. ..... 335/220; 335/222; 335/227; 335/229; 335/234

(58) Field of Search ..... 335/179, 222, 335/229–234

(56) References Cited

U.S. PATENT DOCUMENTS 4,703,297 A * 10/1987 Nagasaka ..... 335/222

* cited by examiner

*Primary Examiner*—Ramon M. Barrera
(74) *Attorney, Agent, or Firm*—Oblon, Spivak, McClelland, Maier & Neustadt, P.C.

(57) ABSTRACT

The invention includes an annular exciting coil 10, a main yoke 12 surrounding a periphery of the exciting coil and having polar teeth 12*a* and 12*b* disposed to face each other on opposite end sides of a central hole 11 of the exciting coil, and a cylindrical permanent magnet 13 disposed in the central hole of the exciting coil to be movable in an axial direction of the hole and polarized in a radial direction.

13 Claims, 7 Drawing Sheets

MAGNET MOVABLE ELECTROMAGNETIC ACTUATOR

TECHNICAL FIELD

The present invention relates to a magnet movable electromagnetic actuator for moving and positioning an object with satisfactory responsivity.

PRIOR ART

Conventionally, an electromagnetic solenoid (actuator) in which voltage is applied to an exciting coil to apply a linear motion to a movable core by a magnetic force is well known as a reciprocation apparatus for magnetically moving an object. Although a structure of this electromagnetic solenoid is simple, the electromagnetic solenoid includes a core inside the coil. Therefore, it is difficult to improve electrical responsivity. Moreover, because thrust cannot be generated when a current is not passed, uses of the electromagnetic solenoid are limited.

To cope with these problems, large voltage is applied on startup or positioning in non-energization is carried out by using a spring. Therefore, complication of the structure and increase in the number of parts are inevitable.

DISCLOSURE OF THE INVENTION

It is an object of the present invention to provide a magnet movable electromagnetic actuator for generating steady-state thrust in a short time with satisfactory responsivity without applying large voltage on startup unlike the prior-art electromagnetic solenoid.

It is another object of the invention to provide a magnet movable electromagnetic actuator in which a movable member can be easily retained in non-energization.

It is yet another object of the invention to provide a small-sized and inexpensive magnet movable electromagnetic actuator including the small number of parts, the electromagnetic actuator showing the above-described features by a simple structure in which a cylindrical permanent magnet polarized in a radial direction is used.

To achieve the above object, a first electromagnetic actuator of the invention comprises: an annular exciting coil; a main yoke surrounding a periphery of the exciting coil and having at a portion of the main yoke a pair of polar teeth positioned to face each other at axial opposite end portions of a central hole of the exciting coil; and a cylindrical permanent magnet disposed in the central hole of the exciting coil to be movable in an axial direction of the central hole and polarized into a north pole and a south pole in a radial direction.

A second magnet movable electromagnetic actuator of the invention comprises: an annular exciting coil; a main yoke surrounding a periphery of the exciting coil and having at a portion of the main yoke a pair of polar teeth positioned to face each other at axial opposite end portions of an outer periphery of the exciting coil; and a cylindrical permanent magnet disposed on an outer peripheral side of the exciting coil to be movable in an axial direction of the coil and polarized into a north pole and a south pole in a radial direction.

In the first and second magnetic movable electromagnetic actuators having the above structures, if the exciting coil is energized, the one polar tooth of the main yoke becomes the north pole while the other polar tooth becomes the south pole according to a direction of the current. If the magnetic poles generated in these polar teeth and a magnetic pole of the permanent magnet on a side facing the polar teeth are different from each other, an attracting force acts between them. If they are the same as each other, repulsion acts between them. Therefore, these forces become axial thrust acting on the permanent magnet and the permanent magnet moves in the axial direction in the central hole of the coil or outside the coil. If the exciting coil is energized in a reverse direction, the magnetic poles, i.e., the north pole and the south pole generated in both the polar teeth of the main yoke are reverse to the above-described case. As a result, the thrust acting on the permanent magnet is also in a reversed direction and the permanent magnet moves in a reverse direction.

As described above, according to the invention, it is advantageously possible to generate steady-state thrust in a short time with satisfactory responsivity without applying large voltage on startup unlike the prior-art electromagnetic solenoid.

In the invention, a cylindrical back yoke positioned coaxially with the cylindrical permanent magnet may be provided on an opposite side to the exciting coil through the permanent magnet, i.e., inside the permanent magnet in the first electromagnetic actuator and outside the permanent magnet in the second electromagnetic actuator. With this structure, because a magnetic path extending from the one polar tooth through the permanent magnet and the back yoke to reach the other polar tooth can be formed, it is possible to reduce a magnetic reluctance and to further increase thrust and the magnetic adsorbing force of the permanent magnet.

If the back yoke is formed to have such a thickness as to be magnetically saturated by a magnetomotive force of the permanent magnet, the permanent magnet can be retained in a neutral position by a magnetic force when the exciting coil is not energized. If the back yoke is formed to have such a thickness as not to be magnetically saturated by a magnetomotive force of the permanent magnet, the permanent magnet can be retained in two positions, i.e., a forward movement end or a rearward movement end by a magnetic force when the exciting coil is not energized.

According to the invention, as a third electromagnetic actuator, there is provided a magnet movable electromagnetic actuator comprising: an annular exciting coil; an annular main yoke surrounding a periphery of the exciting coil and having at a portion of the main yoke a pair of polar teeth positioned to face each other at axial opposite end portions of a central hole of the exciting coil; a cover and a cap respectively mounted to axial opposite end portions of the main yoke to form a casing with the main yoke; a magnet chamber formed inside the casing and having an outer periphery surrounded by the exciting coil and the pair of polar teeth; a permanent magnet formed in a cylindrical shape, polarized into a north pole and a south pole in a radial direction, and disposed in the magnet chamber inside the exciting coil and the polar teeth to be movable in an axial direction of the casing; a magnet holder for holding the per manent magnet and movable with the permanent magnet; and an output shaft passing through a central portion of the magnet chamber to slide in the axial direction of the casing and connected to the magnet holder.

The cylindrical back yoke may be mounted in a fixed manner to the casing to be positioned concentrically with the permanent magnet inside the permanent magnet.

The magnet holder may be repulsed by a spring in a returning direction.

DETAILED DESCRIPTION OF THE INVENTION

Figure 1:
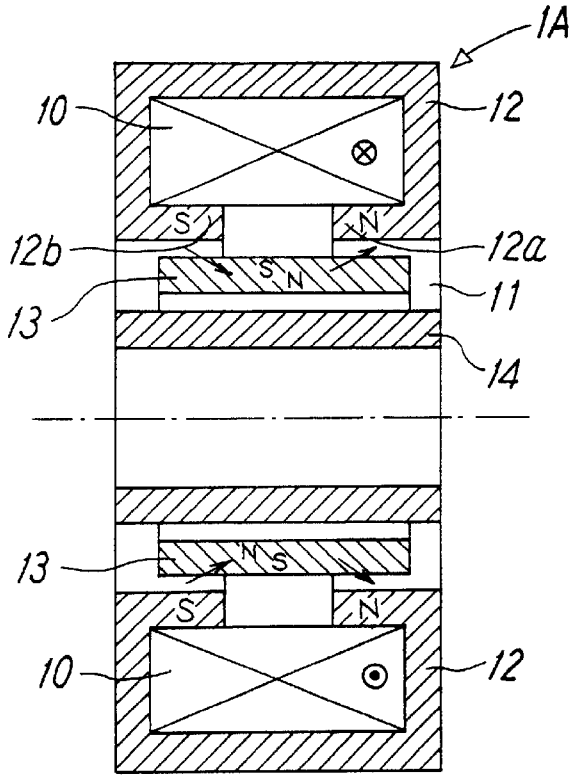
FIG. 1 is a sectional view of a structure of a first magnet movable electromagnetic actuator according to the present invention in terms of a principle.

FIG. 1 shows a structure of a first magnet movable electromagnetic actuator according to the present invention in terms of a principle. The first electromagnetic actuator 1A includes an annular exciting coil 10, an annular main yoke 12 surrounding a periphery of the exciting coil 10 and having at a portion of the main yoke 12 cylindrical polar teeth 12*a* and 12*b* positioned to face each other at opposite end portions of a central hole 11 of the exciting coil 10, a cylindrical permanent magnet 13 disposed in the central hole 11 of the exciting coil to be movable in an axial direction of the hole and polarized into the north pole and the south pole in a radial direction, and a cylindrical back yoke 14 inside the permanent magnet 13. The main yoke 12 and the back yoke 14 are respectively made of magnetic material.

A preferable length of the cylindrical permanent magnet 13 is a length with which a gap between both the polar teeth 12*a* and 12*b* is covered and especially such a length that one end of the permanent magnet 13 reaches one movement end in the central hole 11 of the exciting coil when the other end of the permanent magnet 13 partially overlaps the opposite polar tooth or is positioned close to the polar tooth. The back yoke 14 is not necessarily provided. If the back yoke 14 is provided, the back yoke 14 preferably has a length with which most of the permanent magnet 13 is covered wherever the permanent magnet 13 is in movement.

Figure 2:
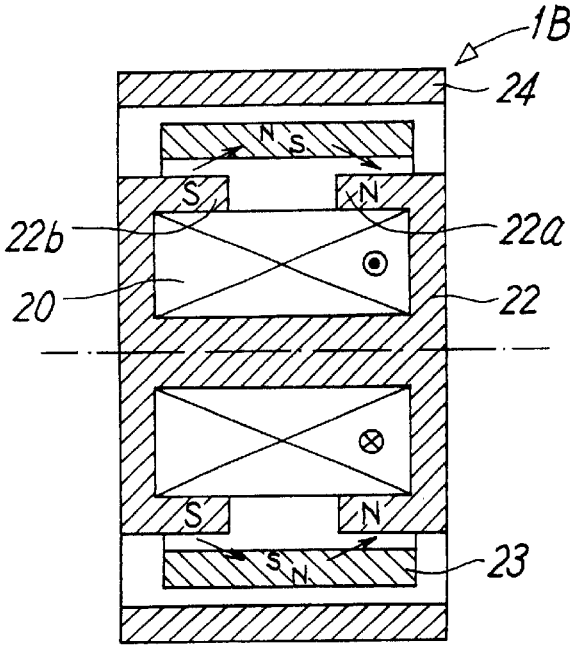
FIG. 2 is a sectional view of a structure of a second magnet movable electromagnetic actuator according to the invention in terms of a principle.

On the other hand, a second magnet movable electromagnetic actuator 1B of the invention shown in FIG. 2 includes an annular exciting coil 20, an annular main yoke 22 surrounding a periphery of the exciting coil 20 and having at a portion of the main yoke 22 cylindrical polar teeth 22*a* and 22*b* positioned to face each other at axial opposite end portions of an outer periphery of the exciting coil 20, a cylindrical permanent magnet 23 disposed outside the exciting coil 20 to be movable in an axial direction of the coil and polarized into the north pole and the south pole in a radial direction, and a cylindrical back yoke 24 disposed outside the permanent magnet 23. Lengths of the permanent magnet 23 and the back yoke 24 and the like are similar to those in the above-described first electromagnetic actuator 1A.

Because the second electromagnetic actuator 1B is different from the first electromagnetic actuator 1A shown in FIG. 1 only in disposition of the exciting coil, the permanent magnet, and the back yoke and there is substantially no difference between the actuators 1A and 1B in terms of functions, only operation of the first electromagnetic actuator 1A in FIG. 1 will be described below and description of operation of the second electromagnetic actuator 1B will be omitted.

In the first electromagnetic actuator 1A having the above structure, as shown in FIG. 1, the permanent magnet 13 is polarized in the radial direction such that an outer side of the permanent magnet 13 is the south pole and an inner side is the north pole. If the exciting coil 10 is energized in a direction shown with symbols in FIG. 1 in this state, the one polar tooth 12*a* of the main yoke 12 becomes the north pole and the other polar tooth 12*b* becomes the south pole due to this direction of a current. Therefore, an attracting force acts between the north pole generated in the polar tooth 12*a* and the south pole on an outer face side of the permanent magnet 13 facing the north pole and repulsion acts between the south pole generated in the polar tooth 12*b* and the south pole of the permanent magnet. Therefore, these forces generate axial thrust in the permanent magnet 13 and the permanent magnet 13 moves axially (rightward in FIG. 1) in the central hole 11 of the coil by the thrust.

If the exciting coil 10 is energized in a reverse direction, magnetic poles of the north pole and the south pole generated in both the polar teeth 12*a* and 12*b* of the main yoke 12 are reverse to the above-described case. As a result, the direction of the thrust generated in the permanent magnet 13 is also reversed (leftward in FIG. 1) and the permanent magnet 13 moves in a direction reverse to the above direction.

Here, if the back yoke 14 is provided, because a magnetic path extending from the polar tooth on the north polar side of the main yoke 12 through the permanent magnet 13 to the back yoke 14 and passing through an outside space to reach the other polar tooth is formed, a magnetic reluctance and the like of the magnetic path are adjusted by a magnetic property, a form of disposition, and the like of the back yoke 14 to thereby adjust the thrust and the magnetic adsorbing force of the permanent magnet 13.

On the other hand, a stop position of the permanent magnet 13 when the exiting coil 10 is not energized changes depending on presence or absence of the back yoke 14, a magnetic saturation property of the back yoke 14, and the like. This will be described below.

Figure 3:
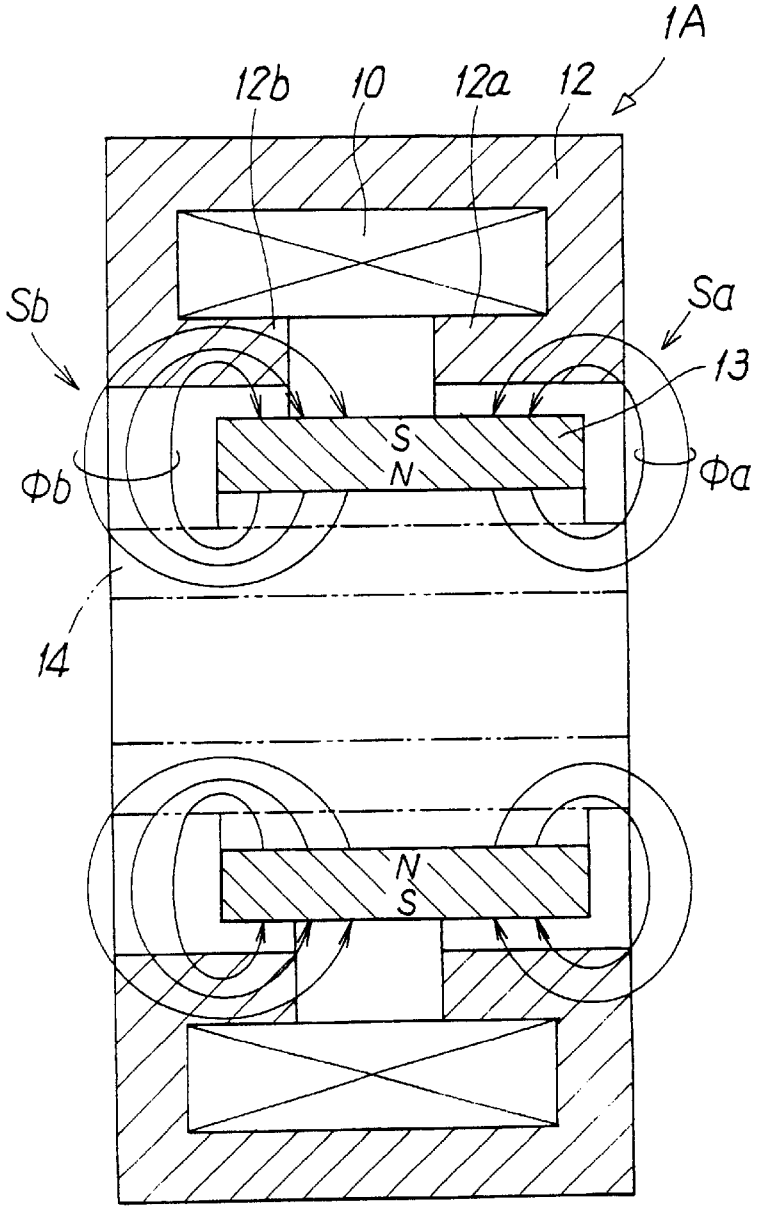
FIG. 3 is a sectional view for explaining a switching operation with regard to an example of the first electromagnetic actuator.

First, if the back yoke 14 is not disposed or if the back yoke 14 is disposed but is thin-walled to such a degree that the back yoke 14 is magnetically saturated by a magnetomotive force of the permanent magnet 13, the permanent magnet 13 is retained in a neutral position when the exciting coil 10 is not energized. In other words, if energization of the exciting coil 10 is interrupted in a state in which the exciting coil 10 has been energized and the permanent magnet 13 has been moved forward to a stroke end on the polar tooth 12*a* side, because the magnetic reluctance of a magnetic path Sa on the polar tooth 12*a* side is smaller than the magnetic reluctance of a magnetic path Sb on the polar tooth 12*b* side at this forward movement end as shown in FIG. 3, magnetic flux $\Phi$ b passing through the magnetic path Sb is more than magnetic flux $\Phi$ a passing through the magnetic path Sa in magnetic flux generated by the magnetomotive force of the permanent magnet 13. As a result, the permanent magnet 13 is attracted and moves toward the polar tooth 12*b*. Then, when the permanent magnet 13 moves to the neutral position, because the magnetic reluctances in the magnetic paths Sa and Sb become equal to each other and a balance is achieved between the magnetic fluxes Φ a and Φ b, the permanent magnet 13 stops in this neutral position. On the other hand, if energization of the exciting coil 10 is interrupted in a state in which the permanent magnet 13 has been moved to a rearward movement stroke end on the polar tooth 12*b* side, the permanent magnet 3 is attracted and moves toward the polar tooth 12*a* in a way reverse to the above case. When the permanent magnet 13 moves to the neutral position, the permanent magnet 13 stops and is retained in the position.

Therefore, if an object to be driven is connected to the permanent magnet 13 and the exciting coil 10 is energized in a normal or reverse direction to move the permanent magnet 13 forward or rearward and then the energization is canceled, the object can be positioned in the neutral position of the permanent magnet 13. This structure is equivalent to provision of mechanical return springs on opposite sides of the permanent magnet 13. Therefore, the structure is efficient when it is used to continuously drive the permanent magnet 13 for reciprocation because switching of the permanent magnet 13 is promoted by a resonant phenomenon.

Figure 4:
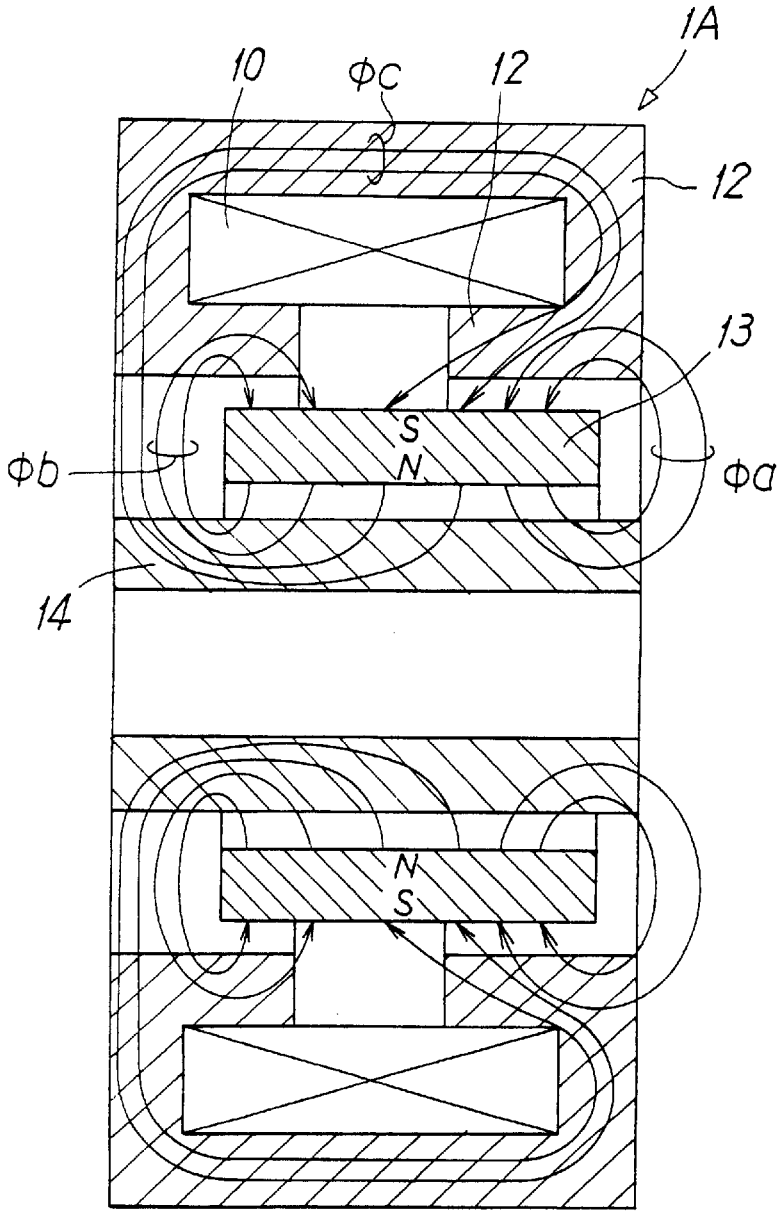
FIG. 4 is a sectional view for explaining a switching operation with regard to another example of the first electromagnetic actuator.

Next, if the back yoke 14 is thick to such a degree that the back yoke 14 is not magnetically saturated by the magnetomotive force of the permanent magnet 13, the permanent magnet 13 is retained in two positions, i.e., the forward movement end or the rearward movement end when the exciting coil 10 is not energized. In other words, if energization of the exciting coil 10 is interrupted in a state in which the exciting coil 10 has been energized and the permanent magnet 13 has been moved forward to a stroke end on the polar tooth 12*a* side, a magnetic flux generated from the permanent magnet 13 is divided into a magnetic flux Φ a extending from the north pole through the back yoke 14 and the polar tooth 12*a* to the south pole, a magnetic flux Φ b extending from the north pole through the back yoke 14 and the polar tooth 12*b* to the south pole, and a magnetic flux Φ c extending from the north pole through the back yoke 14, the polar tooth 12*b*, the main yoke 12, and the polar tooth 12*a* to the south pole as shown in FIG. 4. Therefore, the magnetic flux passing through the polar tooth 12*a* and entering the south polar is Φ a+Φ c which is more than Φ b passing through the polar tooth 12*b* and entering the south pole. As a result, the permanent magnet 13 is retained at the forward movement end while being attracted toward the polar tooth 12*a*. This is also true for a case of interrupting energization of the exciting coil 10 in a state in which the permanent magnet 13 has been moved to the stroke end on the polar tooth 12*b* side. In this case, the permanent magnet 13 is retained at the rearward movement end while being attracted toward the polar tooth 12*b*.

Therefore, if an object to be driven is connected to the permanent magnet 13 and the exciting coil 10 is energized in a normal or reverse direction to move the permanent magnet 13 forward or rearward and then the energization is canceled, the object can be reliably positioned in two positions, i.e., the forward movement end or the rearward movement end.

Figure 5:
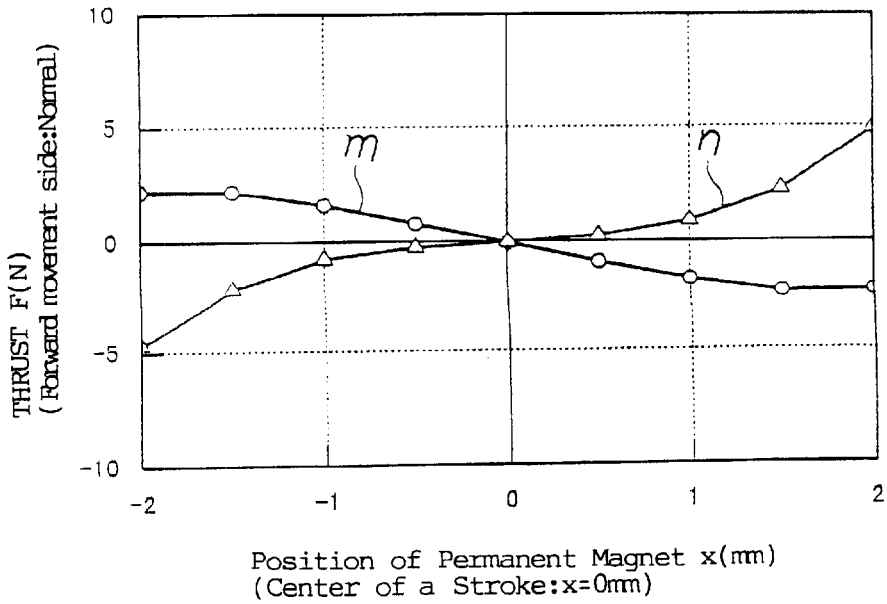
FIG. 5 is a diagram showing an operating property in non-energization according to presence or absence of the back yoke.

FIG. 5 shows a relationship between an operating position of the permanent magnet 13 and magnitude and a direction of the thrust generated by the magnetomotive force of the permanent magnet 13 itself. In FIG. 5, a graphm is a case in which the back yoke 14 is not provided or the back yoke 14 which is thin-walled to such a degree as to be magnetically saturated by the magnetomotive force of the permanent magnet 13 is provided and a graph n is a case in which the back yoke 14 which is thick to such a degree as not to be magnetically saturated by the magnetomotive force of the permanent magnet 13 is provided.

The graph m shows a fact that thrust in a minus direction (rearward direction) acts on the permanent magnet 13 when the permanent magnet 13 is at the forward movement end as shown in FIG. 3 while thrust in a plus direction (forward direction) acts on the permanent magnet 13 when the permanent magnet 13 is at the rearward movement end. Therefore, it is found that the permanent magnet 13 moves to the neutral position and is retained in the neutral position whichever of the forward movement end and the rearward movement end the permanent magnet 13 is at The graph n shows a fact that thrust in the plus direction (forward direction) acts on the permanent magnet 13 when the permanent magnet 13 is at the forward movement end as shown in FIG. 4 while thrust in the minus direction (rearward direction) acts on the permanent magnet 13 when the permanent magnet 13 is at the rearward movement end. Therefore, it is found that the permanent magnet 13 is retained in the respective positions. In this case, the thrust does not similarly act on the permanent magnet when the permanent magnet is in the neutral position.

Figure 6:
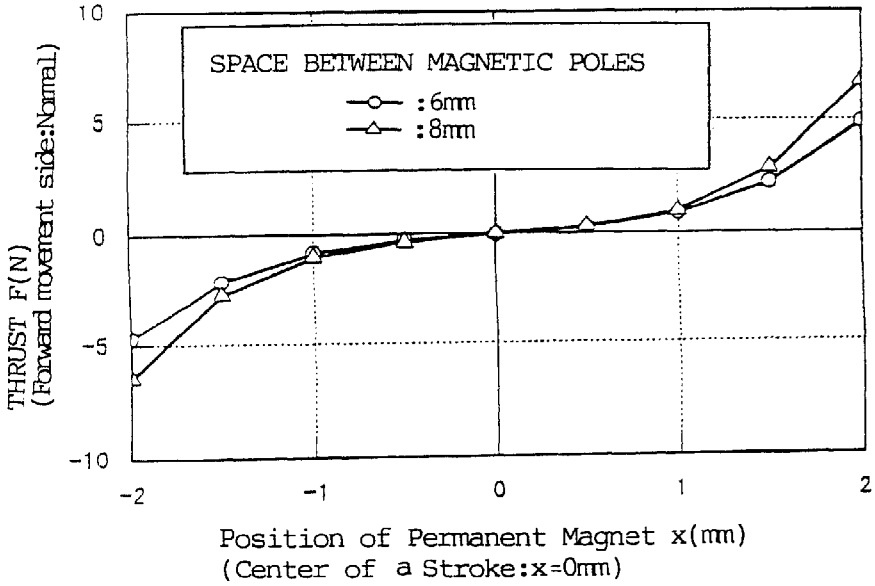
FIG. 6 is a diagram showing a relationship between a space between polar teeth and thrust in non-energization.
Figure 7:
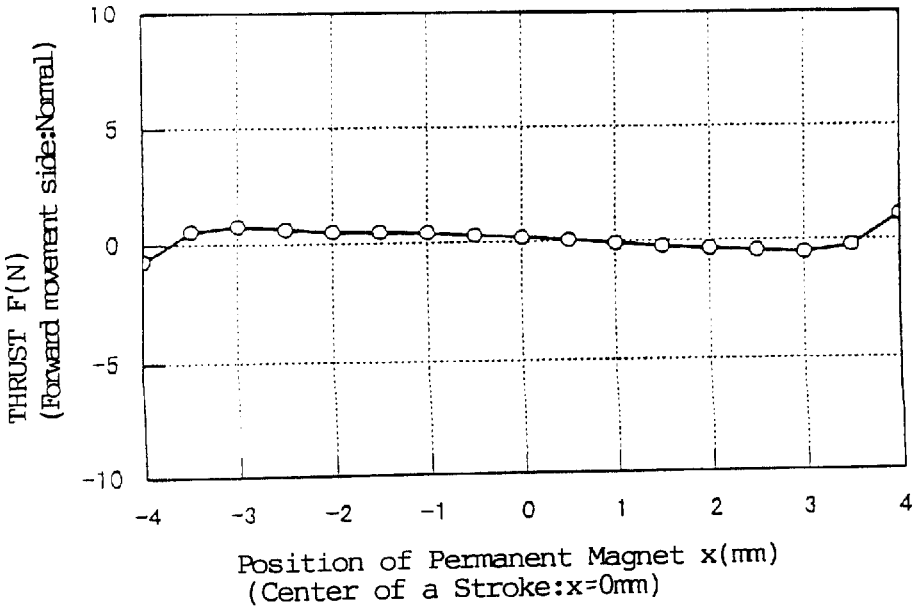
FIG. 7 is a diagram showing an operating property when the thrust in non-energization is minimized throughout a stroke.

As described above, the magnitude of the thrust acting on the permanent magnet 13 when the exciting coil 10 is not energized can be adjusted freely by changing material and a thickness of the back yoke 14, a space between the pair of polar teeth 12*a* and 12*b*, the length of the permanent magnet 13, and the like. As an example of this, FIG. 6 shows an influence of the space between the pair of polar teeth on the thrust property. From FIG. 6, it is found that the thrust reduces as the space between the polar teeth reduces. It is also possible to minimize the thrust acting on the permanent magnet throughout the stroke of the permanent magnet as shown in FIG. 7. In this case, it is possible to stop and retain the permanent magnet and the object and the like retained on the permanent magnet in an arbitrary position. Because the electromagnetic actuator having such a feature has good controllability, the actuator can be applied to a motor for controlling and the like.

Figure 8:
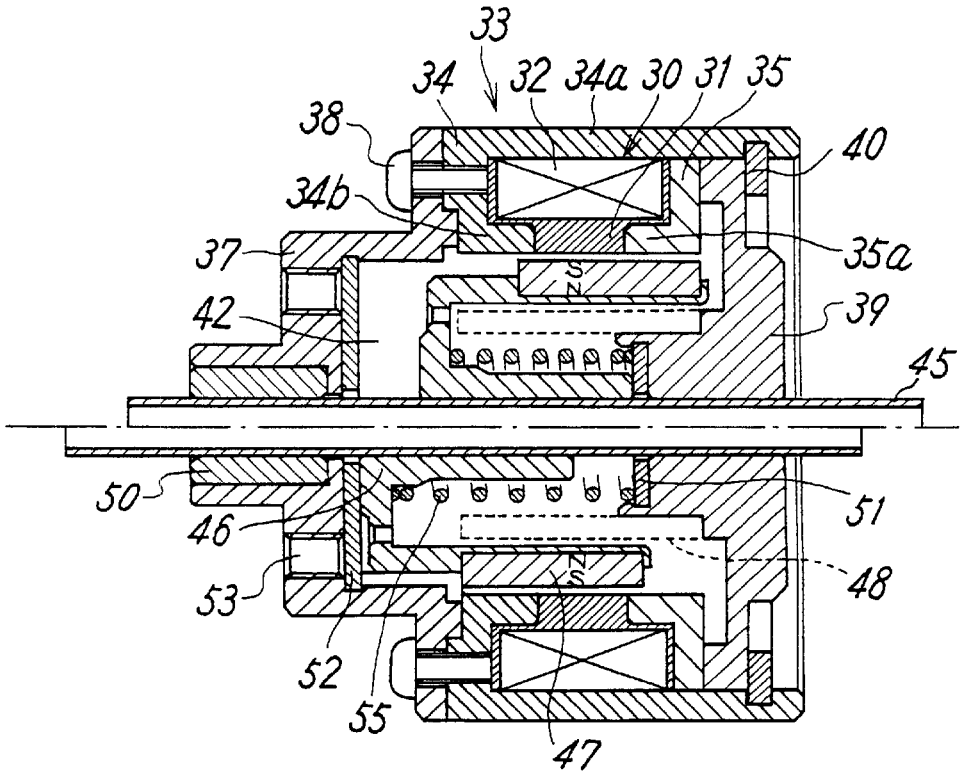
FIG. 8 is a sectional view showing an embodiment in which the electromagnetic actuator in FIG. 1 is embodied and showing different operating states in upper and lower half portions.

FIG. 8 shows an embodiment in which the first electromagnetic actuator 1A shown in FIG. 1 is embodied.

This electromagnetic actuator 1C includes an annular exciting coil 30 formed by providing winding 32 to a bobbin 31 and an annular main yoke 33 surrounding a periphery of the exciting coil 30. This main yoke 33 is formed of an outer yoke 34 in which an outer tube portion 34*a* also functioning as an outer wall of a casing and one polar tooth 34*b* are integrated with each other and a bottom yoke 35 in a L-shaped sectional shape having the other polar tooth 35*a*. The outer yoke 34 and the bottom yoke 35 are mounted to each other such that the polar teeth 35*a* and 34*b* in the pair are positioned at opposite end portions of a central hole of the exciting coil 30 to face each other and the outer yoke 34 and the bottom yoke 35 are connected to each other by means such as screwing.

A cover 37 is fixed to axial one end side of the main yoke 33 through a screw 38 and a cap 39 is fixed to the other end side of the main yoke 33 through a C-type snap ring 40. The casing 41 is formed of the main yoke 33, the cover 37, and the cap 39. In this casing 41, a magnet chamber 42 an outer periphery of which is surrounded by the exciting coil 30 and the pair of polar teeth 35*a* and 34*b* is formed. In this magnet chamber 42, a hollow output shaft 45 which passes through a center of the magnet chamber 42 and can slide in an axial direction is provided, a cylindrical magnet holder 46 is mounted around the shaft 45 to move with the shaft 45, and a cylindrical permanent magnet 47 is mounted to an outer peripheral face of the magnet holder 46 to face the exciting coil 30 and the pair of polar teeth 35*a* and 34*b* inside the coil 30 and the polar teeth 35*a* and 34*b*.

The permanent magnet 47 is polarized into the north pole and the south pole in a radial direction and has such a length that a gap between both the polar teeth 35*a* and 34*b* of the main yoke 33 is covered with the permanent magnet 47 and that one end of the permanent magnet 47 reaches a movement end in the central hole of the exciting coil 30 when the other end of the permanent magnet 47 partially overlaps the opposite polar tooth or is positioned close to the polar tooth.

In the permanent magnet 47, as shown by a chain line in FIG. 8, a cylindrical back yoke 48 can be disposed coaxially with the permanent magnet 47 in a fixed manner by mounting the back yoke 48 to the cap 39. If the back yoke 48 is provided, the back yoke 48 preferably has such a length as to face the permanent magnet 47 wherever the permanent magnet 47 is in movement. As described above, the back yoke 48 is not necessarily provided.

In FIG. 8, a reference numeral 50 designates a bearing provided to the cover 37 to support the shaft 45 for sliding, 51 and 52 designate dampers provided to the cover 37 and the cap 39 to stop the magnet holder 46 at stroke ends in a cushioned manner, 53 designates a screw hole for mounting the electromagnetic actuator to a predetermined place, and 55 designates a return spring for returning the shaft 45 to a return position in a non-energized state.

The electromagnetic actuator 1C having the above structure is used for carrying the object and the like by connecting the object to the shaft 45. In an operating state in which the shaft 45 is positioned at the left end as shown in a lower half of FIG. 8, if the exciting coil 30 is energized and such a current that the one polar tooth 35*a* becomes the north pole and that the other polar tooth 34*b* becomes the south pole is passed, an attracting force acts between the north pole generated in the polar tooth 35*a* and the south pole on the outer face side of the permanent magnet 47 and repulsion acts between the south pole generated in the polar tooth 34*b* and the south pole of the permanent magnet. Therefore, these forces act on the permanent magnet 47 as axial thrust and the permanent magnet 47 moves forward with the shaft 45 to the right end shown in an upper half of FIG. 8.

If a current in a reverse direction is passed through the exciting coil 30 when the permanent magnet 47 is positioned at the forward movement end, magnetic poles reverse to the above-described case are generated in both the polar teeth 35*a* and 34*b*. Therefore, the permanent magnet 47 and the shaft 45 quickly move rearward to the return ends by the resultant of the thrust due to the magnetic force and a repulsing force of the return spring 55. Even if energization of the exciting coil 30 is cancelled at the forward movement end, the permanent magnet 47 and the shaft 45 move to the rearward movement end shown in the lower half portion of FIG. 8 due to the repulsing force of the spring 55.

As described above, if the return spring 55 is provided, the permanent magnet 47 can be switched to two positions, i.e., the forward movement end and the rearward movement end. If the spring 55 is not provided, different switching operations, i.e., passing a current in a reverse direction through the exciting coil 30 or interrupting energization at each the stroke end are carried out according to conditions such as presence or absence of the back yoke 48 and if the back yoke 48 is magnetically saturated by the magnetomotive force of the permanent magnet 47. Because these switching operations are substantially similar to the case described in regard to the first electromagnetic actuator 1A, descriptions of them are omitted here.

Because the radially polarized permanent magnet 47 is used in the electromagnetic actuator 1C, a lateral load acting on a movable portion including the shaft 45, the magnet holder 46, and the movable magnet 47 is small. Therefore, the bearing 50 for supporting the shaft 45 may be a simple one and reduction of cost and improvement of durability due to the small lateral load are expected.

Because the number of members made of iron and provided in the exciting coil 30 can be reduced in the electromagnetic actuator 1C, an inductance of the exciting coil can be reduced. Therefore, rising of a current is satisfactory when step voltage is applied to the coil, electrical responsivity can be improved, and as a result, steady-state thrust can be generated in a short time (about a few ms).

According to the electromagnetic actuator of the invention described above in detail, by simple means in which the cylindrical permanent magnet polarized in the radial direction is used, it is possible to generate steady-state thrust in a short time with satisfactory responsivity without applying large voltage on startup unlike the prior-art electromagnetic solenoid. Furthermore, by the above structure in which the permanent magnet is used, it is possible to reliably retain the object in the desired operating position in non-energization, the number of parts can be reduced to thereby reduce cost, and durability can be improved.

According to the electromagnetic actuator of the invention, based on the above-described structure, it is possible to generate greater thrust than the prior-art electromagnetic solenoid of the same outer dimensions. With the same outer dimensions, it is possible to generate greater thrust. Furthermore, it is possible to reduce the outer dimensions to generate the same degree of thrust.

What is claimed is:

1. A magnet movable electromagnetic actuator comprising:

an annular exciting coil;

a main yoke surrounding a periphery of said exciting coil and having at a portion of said main yoke a pair of polar teeth positioned to face each other at axial opposite end portions of a central hole of said exciting coil;

a cylindrical permanent magnet disposed in said central hole of said exciting coil to be movable in an axial direction of said central hole and polarized into a north pole and a south pole in a radial direction such that a first of the north pole or south pole is polarized on an inner periphery side of the radial direction, and a second of the north pole or south pole is polarized on an outer periphery side of the radial direction; and a cylindrical back yoke positioned coaxially with said cylindrical permanent magnet on an opposite side to said exciting coil through said permanent magnet, wherein said back yoke is formed to have such a thickness as to be magnetically saturated by a magnetomotive force of said permanent magnet so that said permanent magnet is retained in a neutral position by a magnetic force when said exciting coil is not energized.

2. A magnet movable electromagnetic actuator comprising:

an annular exciting coil;

a main yoke surrounding a periphery of said exciting coil and having at a portion of said main yoke a pair of polar teeth positioned to face each other at axial opposite end portions of an outer periphery of said exciting coil;

a cylindrical permanent magnet disposed on an outer peripheral side of said exciting coil to be movable in an axial direction of said coil and polarized into a north pole and a south pole in a radial direction such that a first of the north pole or south pole is polarized on an inner periphery side of the radial direction, and a second of the north pole or south pole is polarized on an outer periphery side of the radial direction; and a cylindrical back yoke positioned coaxially with said cylindrical permanent magnet on an opposite side to said exciting coil over said permanent magnet, wherein said back yoke is formed to have such a thickness as to be magnetically saturated by a magnetomotive force of said permanent magnet so that said permanent magnet is retained in a neutral position by a magnetic force when said exciting coil is not energized.

3. A magnet movable electromagnet actuator comprising:

an annular exciting coil;

a main yoke surrounding a periphery of said exciting coil and having at a portion of said main yoke a pair of polar teeth positioned to face each other at axial opposite end portions of a central hole of said exciting coil;

a cylindrical permanent magnet disposed in said central hole of said exciting coil to be movable in an axial direction of said central hole and polarized into a north pole and a south pole in a radial direction such that a first of the north pole or south pole is polarized on an inner periphery side of the radial direction, and a second of the north pole or south pole is polarized on an outer periphery side of the radial direction; and a cylindrical back yoke positioned coaxially with said cylindrical permanent magnet on an opposite side to said exciting coil through said permanent magnet, wherein said back yoke is formed to have such a thickness as not to be magnetically saturated by a magnetomotive force of said permanent magnet so that said permanent magnet is retained in two positions, i.e., a forward movement end or a rearward movement end by a magnetic force when said exciting coil is not energized.

4. A magnet movable electromagnet actuator comprising:

an annular exciting coil;

a main yoke surrounding a periphery of said exciting coil and having at a portion of said main yoke a pair of polar teeth positioned to face each other at axial opposite end portions of an outer periphery of said exciting coil;

a cylindrical permanent magnet disposed on an outer peripheral side of said exciting coil to be movable in an axial direction of said coil and polarized into a north pole and a south pole in a radial direction such that a first of the north pole or south pole is polarized on an inner periphery side of the radial direction, and a second of the north pole or south pole is polarized on an outer periphery side of the radial direction; and a cylindrical back yoke positioned coaxially with said cylindrical permanent magnet on an opposite side to said exciting coil over said permanent magnet, wherein said back yoke is formed to have such a thickness as not to be magnetically saturated by a magnetomotive force of said permanent magnet so that said permanent magnet is retained in two positions, i.e., a forward movement end or a rearward movement end by a magnetic force when said exciting coil is not energized.

5. A magnet movable electromagnetic actuator comprising:

an annular exciting coil;

an annular main yoke surrounding a periphery of said exciting coil and having at a portion of said main yoke a pair of polar teeth positioned to face each other at axial opposite end portions of a central hole of said exciting coil;

a cover and a cap respectively mounted to axial opposite end portions of said main yoke to form a casing with said main yoke;

a magnet chamber formed inside said casing and having an outer periphery surrounded by said exciting coil and said pair of polar teeth;

a permanent magnet formed in a cylindrical shape, polarized into a north pole and a south pole in a radial direction, and disposed in said magnet chamber inside said exciting coil and said polar teeth to be movable in an axial direction of said casing;

a magnet holder for holding said permanent magnet and movable with said permanent magnet; and an output shaft passing through a central portion of said magnet chamber to slide in said axial direction of said casing and connected to said magnet holder.

6. An electromagnetic actuator according to claim 5, wherein a cylindrical back yoke is mounted in a fixed manner to said casing to be positioned concentrically with said permanent magnet inside said permanent magnet.

7. An electromagnetic actuator according to claim 6, wherein said back yoke is formed to have such a thickness as to be magnetically saturated by a magnetomotive force of said permanent magnet so that said permanent magnet is retained in a neutral position by a magnetic force when said exciting coil is not energized.

8. An electromagnet actuator according to claim 6, wherein said back yoke is formed to have such a thickness as not to be magnetically saturated by a magnetomotive force of said permanent magnet so that said permanent magnet is retained in two positions, i.e., a forward movement end or a rearward movement end by a magnetic force when said exciting coil is not energized.

9. An electromagnetic actuator according to claim 5, wherein said magnet holder is repulsed by a spring in a returning direction.

10. A magnet movable electromagnetic actuator comprising:

an annular exciting coil;

a main yoke surrounding a periphery of said exciting coil and having at a portion of said main yoke a pair of polar teeth positioned to face each other at axial opposite end portions of a central hole of said exciting coil;

a cylindrical permanent magnet disposed in said central hole of said exciting coil to be movable in an axial direction of said coil and polarized into a north pole and a south pole in a radial direction; and a cylindrical back yoke positioned coaxially with said cylindrical permanent magnet on an opposite side to said exciting coil through said permanent magnet, wherein said back yoke is formed to have such a thickness as to be magnetically saturated by a magnetomotive force of said permanent magnet so that said permanent magnet is retained in a neutral position by a magnetic force when said exciting coil is not energized.

11. A magnet movable electromagnetic actuator comprising:

an annular exciting coil;

a main yoke surrounding a periphery of said exciting coil and having at a portion of said main yoke a pair of polar teeth positioned to face each other at axial opposite end portions of an outer periphery of said exciting coil;

a cylindrical permanent magnet disposed on an outer peripheral side of said exciting coil to be movable in an axial direction of said coil and polarized into a north pole and a south pole in a radial direction; and a cylindrical back yoke positioned coaxially with said cylindrical permanent magnet on an opposite side to said exciting coil over said permanent magnet, wherein said back yoke is formed to have such a thickness as to be magnetically saturated by a magnetomotive force of said permanent magnet so that said permanent magnet is retained in a neutral position by a magnetic force when said exciting coil is not energized.

12. A magnet movable electromagnet actuator comprising:

an annular exciting coil;

a main yoke surrounding a periphery of said exciting coil and having at a portion of said main yoke a pair of polar teeth positioned to face each other at axial opposite end portions of a central hole of said exciting coil;

a cylindrical permanent magnet disposed in said central hole of said exciting coil to be movable in an axial direction of said central hole and polarized into a north pole and a south pole in a radial direction; and a cylindrical back yoke positioned coaxially with said cylindrical permanent magnet on an opposite side to said exciting coil through said permanent magnet, wherein said back yoke is formed to have such a thickness as not to be magnetically saturated by a magnetomotive force of said permanent magnet so that said permanent magnet is retained in two positions, i.e., a forward movement end or a rearward movement end by a magnetic force when said exciting coil is not energized.

13. A magnet movable electromagnet actuator comprising:

an annular exciting coil;

a main yoke surrounding a periphery of said exciting coil and having at a portion of said main yoke a pair of polar teeth positioned to face each other at axial opposite end portions of an outer periphery of said exciting coil;

a cylindrical permanent magnet disposed on an outer peripheral side of said exciting coil to be movable in an axial direction of said coil and polarized into a north pole and a south pole in a radial direction; and a cylindrical back yoke positioned coaxially with said cylindrical permanent magnet on an opposite side to said exciting coil over said permanent magnet, wherein said back yoke is formed to have such a thickness as not to be magnetically saturated by a magnetomotive force of said permanent magnet so that said permanent magnet is retained in two positions, i.e., a forward movement end or a rearward movement end by a magnetic force when said exciting coil is not energized.

* * * * *